United States Patent [19]

Gaspar

[11] Patent Number: 5,040,593

[45] Date of Patent: Aug. 20, 1991

[54] SIDE FEED TUNDISH APPARATUS AND METHOD FOR THE RAPID SOLIDIFICATION OF MOLTEN MATERIALS

[75] Inventor: Thomas Gaspar, Bexley, Ohio

[73] Assignee: Ribbon Technology Corporation, Gahanna, Ohio

[21] Appl. No.: 364,231

[22] Filed: Jun. 12, 1989

[51] Int. Cl.[5] ..... B22D 11/06; B22D 41/00

[52] U.S. Cl. ..... 164/463; 164/423; 164/429; 164/437; 164/461; 164/479; 164/488; 164/489; 222/590; 222/591

[58] Field of Search ..... 164/463, 479, 488, 489, 164/423, 429, 437, 461, 420; 222/590, 591, 594

[56] References Cited

U.S. PATENT DOCUMENTS

| | | | |
|---|---|---|---|
| 993,904 | 5/1911 | Strange | 164/429 |
| 4,326,579 | 4/1982 | Pond, Sr. et al. | 164/463 X |
| 4,485,839 | 12/1984 | Ward | 164/463 |
| 4,540,546 | 9/1985 | Giessen | 164/463 X |
| 4,582,116 | 4/1986 | Ray et al. | 164/479 X |
| 4,890,662 | 1/1990 | Sanchez-Caldera et al. | 164/463 X |
| 4,928,748 | 5/1990 | Guthrie et al. | 164/488 X |

FOREIGN PATENT DOCUMENTS

| | | | |
|---|---|---|---|
| 60-174239 | 9/1985 | Japan | 164/463 |
| 1020182 | 5/1983 | U.S.S.R. | 164/437 |
| 15548 | of 1914 | United Kingdom | 164/429 |

*Primary Examiner*—J. Reed Batten, Jr.
*Attorney, Agent, or Firm*—Frank H. Foster

[57] ABSTRACT

The flow control of molten material in a tundish is improved by the design of a perpendicular turn in the path of flow of the molten material as the flow leaves an intermediate section of the tundish or casting receptacle and overflows transversely an exit lip to thereby contact a heat-extracting substrate. The perpendicular turn in the flow achieves improved control of the molten material's velocity profile, cooling rate, and depth and flow uniformity of the molten material in the casting receptacle. The essentially perpendicular turn in the path of the molten material from the intermediate section causes the molten material to approach the exit lip in a transverse direction unlike conventional laminar or direct delivery molten flow. The transverse flow relative to the direction of the exit overflow toward the casting or cooling surface facilitates improved mixing of the molten material, improved control of the depth gradient, and improved control of the velocity into the exit lip.

13 Claims, 4 Drawing Sheets

SIDE FEED TUNDISH APPARATUS AND METHOD FOR THE RAPID SOLIDIFICATION OF MOLTEN MATERIALS

This invention was made with Government support under Contract No. F33615-88-C-5411, awarded by the Department of the Air Force. The Government has certain rights in this invention.

TECHNICAL FIELD

This invention relates generally to an improved method and apparatus for preparing ribbon, filaments, fiber, or film from a molten material by moving a surface of a substrate past a region of contact with the molten material and removing it from the substrate. More specifically, the invention relates to an improved design of the casting receptacle whereby a more uniform flow of molten material, such as metals and ceramics, is obtained across the width of the region of contact between the molten material and the surface of the moving substrate.

BACKGROUND OF THE INVENTION

In conventional casting of metal ribbon, filaments, fiber, or film it is often difficult to obtain and/or maintain a uniform flow of molten material across the exit or pouring lip of a tundish onto the surface of a heat-extracting substrate. This difficulty is due to, among other factors, non-uniform temperature distribution of the molten metal or metals in various parts of the tundish, or to non-uniform mixing of the molten material, or to non-uniform velocity of the molten material as it flows through the tundish toward the pouring lip.

Various systems have been employed to attempt to avoid these problems For example, U.S. Pat. No. 4,678,719, issued on July 7, 1987 to Johns et al. and assigned to Allegheny Ludlum Corporation, teaches a widening tundish in an attempt to control the velocity profile of the flow of molten material to thereby aid strip casting of crystalline metal. However, additional baffles and weirs are needed to further control the velocity profile toward the cooling substrate and/or to control the depth of the molten material across the width of the tundish. Furthermore, the design of Johns et al. provides only laminar flow or direct delivery of the molten flow to the casting or cooling surface. This can result in non-uniform delivery rate across the surface of the cooling substrate.

Hackman, et al., in U.S. Pat. No. 4,813,472, issued Mar. 21, 1989, teaches an improved method for producing filaments or fiber from a molten material by overflowing the molten material against the surface of a rotating cooling substrate.

Also known are orifice-type casting systems wherein molten material is delivered from a nozzle to the quenching or casting surface. However, poor quality can result from such casting systems due to non-uniform cooling, partial shrinkage of the strip, and the development of cracks in the strip.

In addition, orifice-type extrusion systems suffer from relative complexity of the necessary process control systems and the difficulty in passing a molten material through fixed, small orifices. The orifice must be constructed from an exotic material if the molten material has a relatively high melting point. The orifices have a tendency to erode and/or become partially or completely blocked due to the freezing of material on the orifice.

Witt, et al., U.S. Pat. No. 4,229,231, issued Oct. 21, 1980, claims a method of forming a multilayered solid structure by means of rapid quenching of separate melts on a fast moving heat extracting surface. However, Witt et al. is directed to orifice extrusion technology. Similarly, Pond et al. in U.S. Pat. No. 4,326,579, issued Apr. 27, 1982, claims an extrusion method for forming a filament from molten material.

Conventional casting methods also suffer from a lack of control over the wetting of the exit lip and/or the surface of the cooling substrate. This lack of control diminishes the width or the quality of the cast strip and often requires considerable time and effort to achieve the desired wetting of the exit lip and the cooling substrate necessary to produce acceptable cast product.

Thus a method and apparatus is desirable which is suitable for commercial production of strip at reduced cost and with improved control of the molten material flow.

It is an object of the present invention to provide a method and an apparatus for improved direct casting of metal strip, which method is superior to orifice-type casting and other known casting processes.

Another object of the present invention is to provide a system for forming ribbon, filaments, fiber, or film products directly from a molten material in a manner whereby the depth, cooling rate, wetting of the exit lip, and velocity of the molten material flowing toward a cooling substrate are controlled.

SUMMARY OF THE INVENTION

In accordance with the present invention, a method is provided for directly casting molten material to continuous strip. The present invention relates to an improved design of a tundish or casting receptacle, whereby a uniform flow of molten material is obtained across the width of the region of contact between the molten material and the surface of a moving and cooling substrate. By the present invention, the control of the velocity profile, cooling rate, and depth uniformity of the molten material in the casting receptacle is improved.

The present invention is related to the subject matter of U.S. Pat. No. 4,813,472, issued to Hackman et al. on Mar. 21, 1989, which is incorporated herein by reference.

By "molten material" herein is meant any melted or flowable metal, metal alloy, ceramic material, or blend or mixture thereof.

By "tundish" herein is meant any tundish, casting receptacle, melting reservoir, vessel, container, or other receiver or conveyor of molten material.

The process improvement of the present invention is achieved by designing an essentially perpendicular turn in the path of the flow of the molten material as it flows from the intermediate section of a casting receptacle before the molten material is exposed to a cooling substrate. The improvement is enhanced according to the present invention by supplying at least one feeding source, and preferably two or more opposing feeding sources, to the intermediate section of the casting receptacle, whereby uniform mixing and flow toward an exit lip of the receptacle is obtained. The essentially perpendicular turn in the path of the molten material from the feeding source or sources causes the molten material to approach the exit lip in a transverse direction unlike conventional laminar or direct delivery molten flow.

The transverse flow relative to the direction of the exit flow toward the casting or cooling surface facilitates improved mixing of the molten material, improved control of the depth gradient, and improved control of the velocity into the exit lip. The transverse flow relative to the direction of the exit flow toward the casting or cooling surface also facilitates faster wetting of the exit lip and more uniform wetting of the cooling substrate. In this manner, solidified strip can be pulled almost immediately from the receptacle containing molten material.

DETAILED DESCRIPTION OF THE INVENTION

Figure 1:
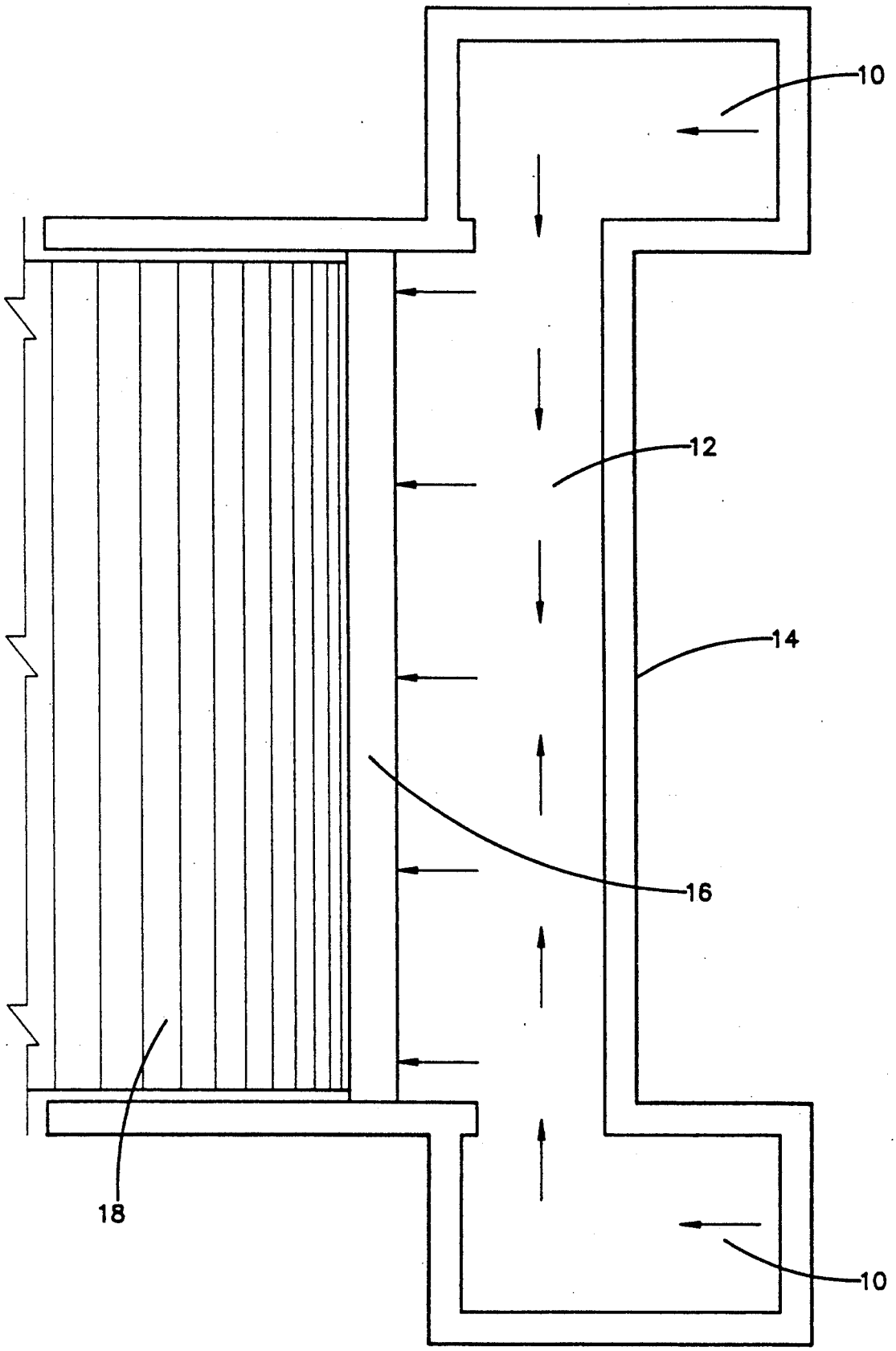
FIG. 1 is a top plan view of a dual side feed melt overflow tundish apparatus.

FIG. 1 illustrates a dual side feed melt overflow tundish apparatus possessing two laterally displaced side feeding sources 10 into which the molten material is fed. A continual supply of fresh molten material may be delivered to the rear of each of the side feeding sources 10 at a controlled rate by a conventional means such as a ladle, funnel, or submerged nozzle. The molten material preferably flows within the side feeding sources 10 in the general direction of the chilled roll moving substrate 18 but on a path within the feeding sources laterally displaced therefrom. The molten material will preferably, but not necessarily, then negotiate an essentially perpendicular turn so as to enter the intermediate section 12 of the casting receptacle 14. However, the feeding source or sources 10 need not be perpendicular to the end of the intermediate section 12 but rather can extend outwardly from the intermediate section 12. The molten materials which flow from the two side feeding sources 10 meet and mix in or near the center of the intermediate section 12 of the casting receptacle 14. The mixed molten material is then allowed to transversely overflow the exit lip 16 onto the chilled roll moving substrate 18 which is cold enough to cause the molten material to at least partially solidify.

Figure 2:
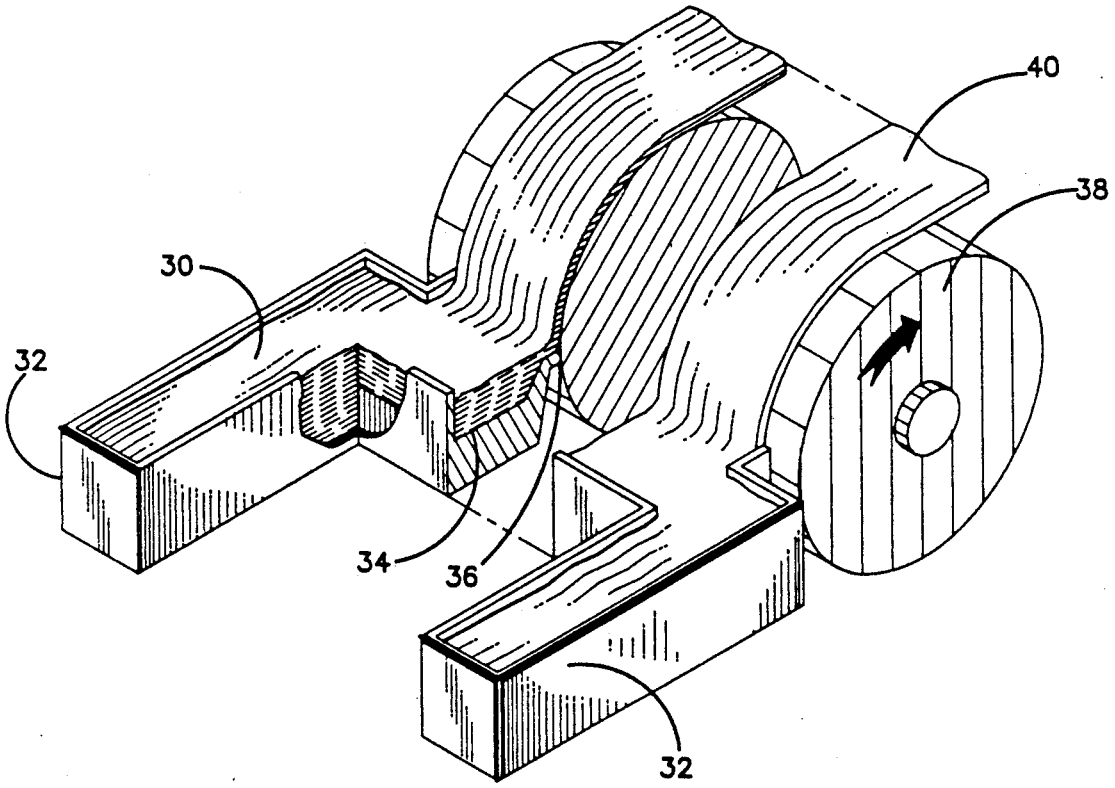
FIG. 2 is a diagrammatic illustration of the dual side feed melt overflow tundish embodiment shown in FIG. 1.

FIG. 2 illustrates a similar receptacle with two laterally displaced side feeding sources 32 into which the molten material 30 is dropped or fed from, for example, a nozzle or funnel. The molten material 30 can flow in the general direction of the chilled roll moving substrate 38 but on a path within the side feeding sources 32 laterally displaced therefrom. However, as described above, the side feeding sources 32 need not be perpendicular to the intermediate section 34 but can extend outwardly therefrom. The molten material is preferably but not by limitation herein caused to turn essentially 90° to enter the intermediate section 34 of the casting receptacle. The molten materials from the two side feeding sources 32 meet and mix in or near the center of the intermediate section 34. The mixed molten material is allowed to overflow the exit lip 36 to thereby contact and flow over the chilled roll moving substrate 38. The mixed molten material thereby at least partially solidifies to form a ribbon, filament, fiber, or film.

As illustrated in FIG. 2 and applicable to all embodiments of the invention, the substrate 38 is moved along a region of contact or a melt front positioned at an edge of the upper surface of the molten material 30. The substrate 38 moves generally transversely or obliquely to the plane of the molten material surface. The layer of molten material which contacts the substrate 38 is carried upwardly away from the molten material for cooling and removal from the substrate 38.

Figure 3:
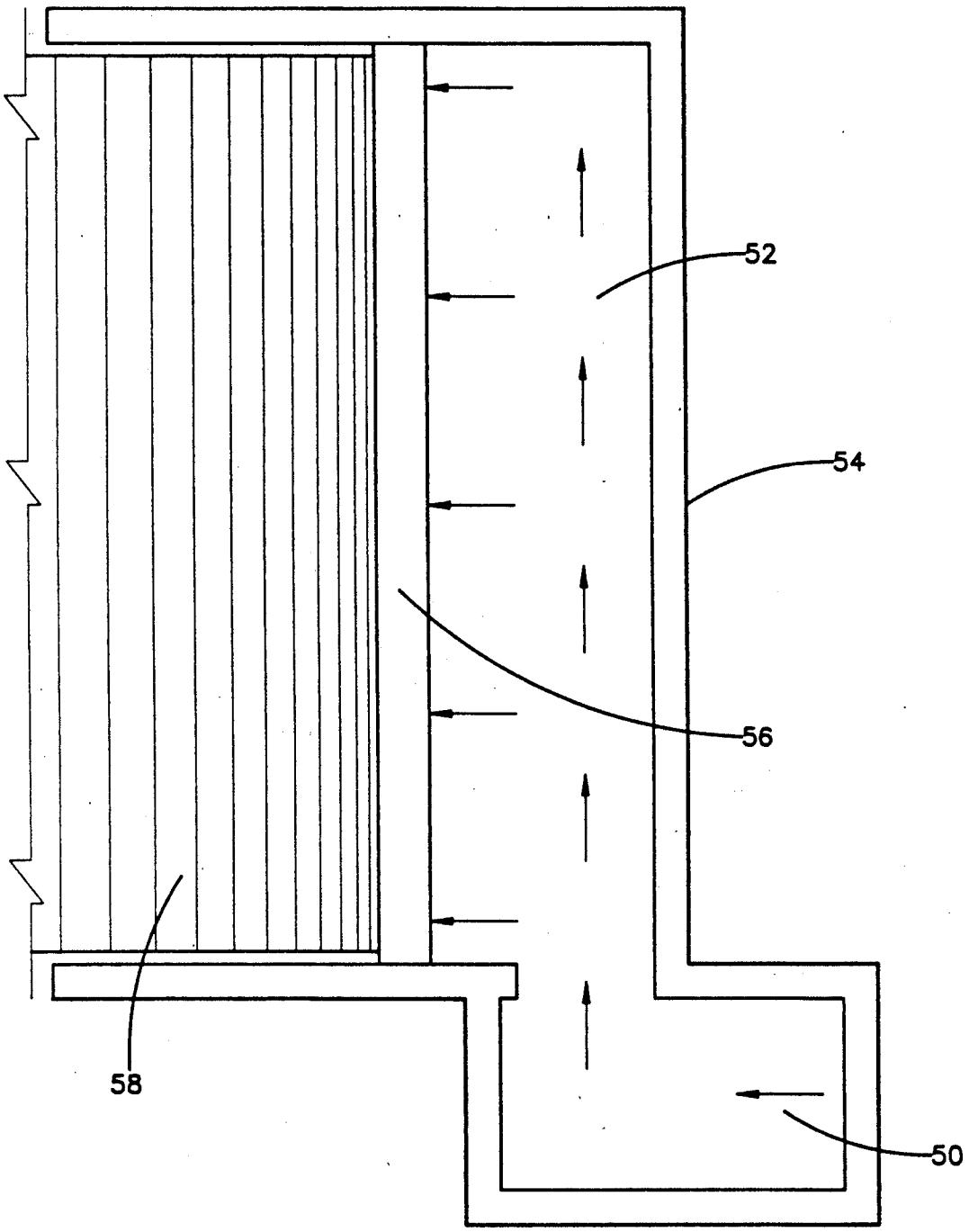
FIG. 3 is a top plan view of a single side feed melt overflow tundish apparatus.

FIG. 3 illustrates a single side feed melt overflow tundish apparatus 54 possessing a single laterally displaced side feeding source 50 into which the molten material is fed. The molten material flows through the single side feeding source 50 and preferably but not necessarily negotiates an essentially perpendicular turn, if any, into the intermediate section 52 of the casting receptacle. The molten material is intimately mixed within the intermediate section 52 and is allowed to transversely overflow the exit lip 56 to contact the chilled roll moving substrate 58. The molten material then at least partially solidifies on the moving substrate 58.

Figure 4:
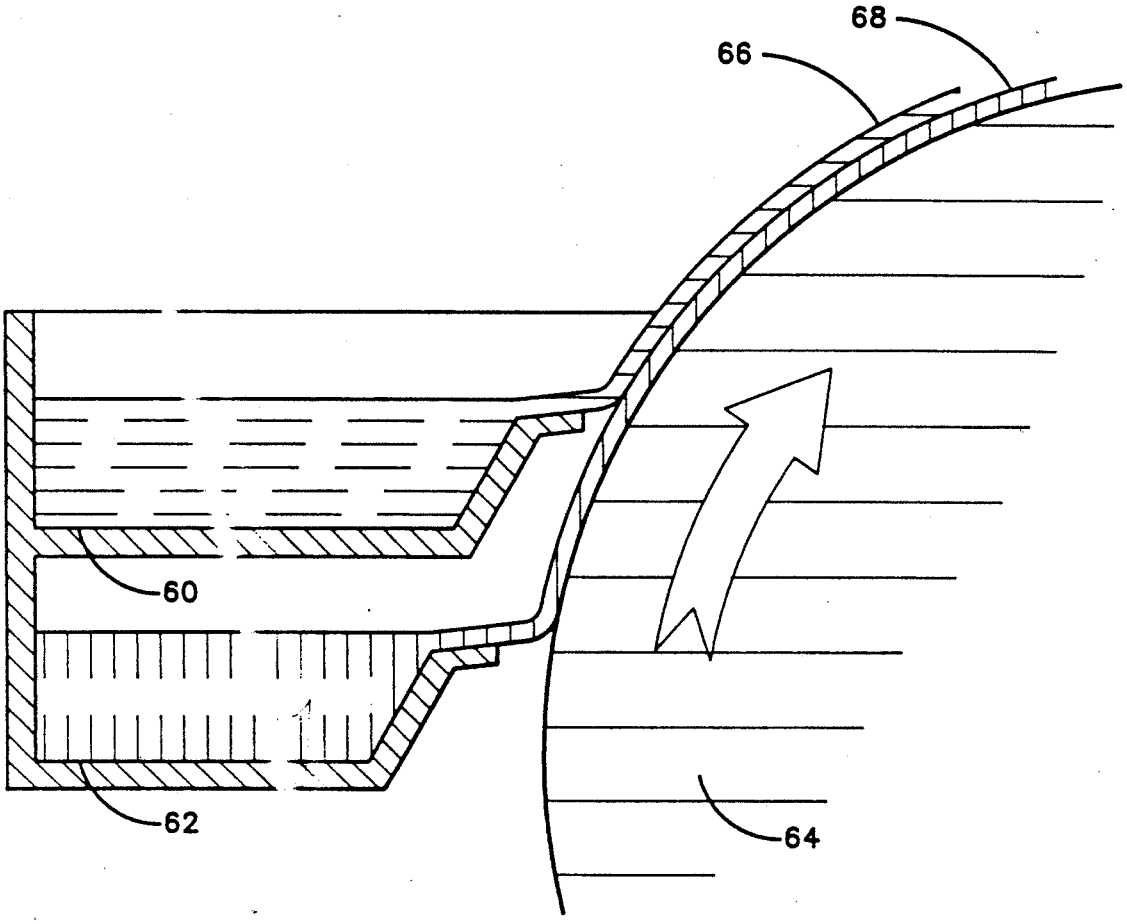
FIG. 4 is a side plan view of a bilevel tundish of the present invention.

FIG. 4 illustrates another embodiment of the present invention, whereby a bilevel tundish apparatus is provided for pouring molten materials. The apparatus comprises a tundish with at least two different levels, 60 and 62, whereby the tundish has two or more separate compartments such that two or more molten materials can be deposited independently onto a cooling substrate, such as a rotating wheel 64. In this embodiment, the tundish has an upper compartment 60 and a lower compartment 62, whereby the upper and lower compartments feed molten materials independently onto the cooling substrate 64 such that the molten material 66 fed onto the cooling substrate from the upper compartment overlays the molten material 68 fed onto the cooling substrate from the lower compartment, whereby both layers cool and solidify and bimaterial or multimaterial strip is cast. Where the molten material is metal, there is produced by this embodiment bimetallic or multimetallic strip, fiber, filament, film, or ribbon. This embodiment can also comprise the essentially perpendicularly shaped feeding end/intermediate section in the tundish described above.

The significant feature of the present invention is the shape of the receptacle or casting vessel, often called a tundish, and the single or dual side feeding sources which convey the molten material to the intermediate section of the tundish and thence to the exit lip. The process improvement of the present invention is achieved by designing an essentially perpendicular turn in the path of the flow of the molten material from the intermediate section of the casting receptacle to the exit lip, whereby uniform mixing and flow toward the exit lip of the receptacle is obtained before the exit lip is encountered. The essentially perpendicular turn in the path of the molten material causes the molten material to approach the exit lip from the intermediate section in a direction transverse to the eventual exit overflow, unlike conventional laminar or direct delivery molten flow. This transverse approach relative to the exit lip reduces the velocity profile of the molten material in the direction of the exit lip to essentially zero, while not sacrificing the mixing nor allowing the molten material to stand, and thus solidify, in the casting receptacle.

Furthermore, in one embodiment of the present invention the path of delivery of the molten material after the 90 degree turn from the side feeding source to the cooling substrate is such that another essentially 90 degree turn in the flow of the molten material is required for the molten material to encounter the exit lip and thereafter the cooling substrate. This additional 90 degree turn occurs in the direction in which the molten material has essentially zero velocity vector. The molten material in this portion of the casting receptacle or tundish is presented to the chill block or cooling substrate as a static, quiescent melt pool across the exit lip of the tundish. The side feeding produces a surprisingly smooth, calm, and steady yet well mixed pool of molten material to be delivered to the exit lip. This feature of the present invention helps to improve control in the uniformity of the molten material depth across, and flow toward, the exit lip, as well as the improved mixing.

Thus by the present invention either a single side feeding source or two or more side feeding sources are effective in achieving the desired objectives. For wider strip casting, dual feed sources are more effective, provide more uniform melt flow to and at the exit lip, and produce solidified strip quicker than single side feed or conventional direct or laminar flow feed sources.

The method and apparatus of the present invention are best exemplified by a tundish, which includes an upper, generally horizontal edge or lip which is relatively lower than the top of the receptacle. A molten material, such as a metal or ceramic material, is fed from one or more laterally displaced feeding sources into the intermediate section of the receptacle to a level such that it overflows, generally transversely, this edge, also referred herein as the exit lip. The laterally displaced feeding source or sources may be deeper than, equal to, or shallower than the intermediate section of the tundish. A movably mounted heat extracting substrate, such as a chilled roll moving substrate, is spaced from the exit edge or lip of the tundish and mounted to be contacted by the overflowed molten material, for example, substantially at the level of the upper surface of the molten material.

The moving substrate surface can be effectively substituted for a portion of the container wall which is absent above the substantially horizontal edge. The molten material flow, after negotiating the essentially perpendicular turn from the intermediate section is overflowed or poured against that substrate surface.

Thus the present invention also relates to an improved method for producing ribbon, filaments, fiber, or film from a molten material, said method being the type wherein a layer of said molten material is solidified on a heat-extracting substrate by moving a surface of the substrate past a region of contact with the molten material, cooling the molten material and removing it from the substrate, wherein the method comprises:

(a) supplying a molten material to one or more feeding ends of a substantially horizontal casting receptacle, wherein the feeding ends are adjacent to and contiguous with a substantially horizontal intermediate section of the casting receptacle, wherein said intermediate section of the casting receptacle has an exit lip which is adjacent to a moving substrate;

(b) causing the molten material to flow through the feeding end or ends and into said intermediate section of said casting receptacle, whereby mixing of the molten material from the feeding end or ends occurs in said intermediate section;

(c) allowing the mixed molten material of step (b) to flow to said exit lip of said intermediate section of the casting receptacle, whereby a uniform flow of molten material is obtained across the width of the exit lip, and whereby the direction of flow of the molten material from the intermediate section of the receptacle to the exit lip is essentially perpendicular to the flows entering the intermediate section from the lateral feeding end or ends; and, (d) contacting the molten material at the exit lip of the casting receptacle with the surface of the moving substrate, whereby the molten material at least partially solidifies in the form of ribbon, filaments, fiber, or film, depending on the surface geometry of the substrate.

When two or more feeding sources are utilized, the directions of the flows of the feeds are preferably from opposite sides of the intermediate section of the casting receptacle, whereby the flows are opposing each other and are each transverse to the overflow from the exit lip onto the moving and/or cooling substrate.

By the present invention, molten materials are fed into a substantially horizontal intermediate section of the casting receptacle through side feeding ends causing the molten material to flow through the feeding ends, through the optional essentially 90 degree angle, and into said intermediate section of said casting receptacle from a lateral direction, whereby mixing of the molten materials from the feeding end or ends occurs.

The molten materials which can be used in the above embodiments include metals, blends, alloys, mixtures, and the like. The metals can include but are not limited to iron, steel, titanium, niobium, tantalum, tungsten, molybdenum, copper, cobalt, zinc, lead, nickel, gold, silver, platinum, magnesium, silicon, and aluminum and alloys and mixtures thereof.

The casting receptacle of the present invention can be lined with or produced from, for example, a ceramic refractory material or graphite. However, this is not a limitation of the present invention. It is only required herein that the tundish or its lining or both be made of a material with a melting point higher than that of the molten material. When used in the present invention, the lining or mat acts as a heat extracting medium causing solidification of a skull of material which acts to protect the remaining molten material from contamination by or from the surfaces of the receptacle.

In the operation of the present invention, a nozzle or opening from a ladle or funnel or receptacle feeding into the tundish is preferred. The nozzle serves to control or meter the molten material flow into the side feeding source or sources of the tundish. The nozzle can be an annular nozzle and can be positioned so as to drop the molten material from some predetermined height into the side feeding source or sources of the tundish. Alternatively, the nozzle can be positioned such that the nozzle opening is submerged beneath the surface level of the molten material within the side feeding source or sources of the tundish. It has been discovered that the side feeding tundish performance can thus be improved by the metering effect of the nozzle or orifice.

While certain preferred embodiments of the present invention have been disclosed in detail, it is to be understood that various modifications in its structure may be adopted without departing from the spirit of the invention or the scope of the following claims.

That which is claimed is:

1. An improved method for producing ribbon, filaments, fiber, or film from a molten material, said method being that type wherein a layer of said molten material is solidified on a heat-extracting substrate by raising the free upper surface of the molten material so that the molten material overflows over an exit lip formed in a side of a casting receptacle onto a surface of the substrate which is moving upwardly past a region of contact with an edge of the upper surface of the molten material, cooling the molten material and removing it from the substrate, wherein the method comprises the steps of:

(a) supplying into the casting receptacle a molten material having a free upper surface from at least one feeding source which is laterally adjacent and contiguous to the casting receptacle, said supplying being directed along a horizontal flow path which is substantially parallel to said region of contact and which maintains a free upper surface in the casting receptacle as substantially a continuous horizontal extension of the free upper surface of the molten material in the feeding source; and (b) causing the molten material which enters the casting receptacle to flow substantially perpendicularly to said region of contact by allowing the molten material in the casting receptacle to overflow the exit lip onto the moving substrate;

wherein the change in flow path direction causes mixing of the molten material to improve its homogeneity.

2. The method of claim 1 wherein the casting receptacle is heat extracting, whereby at least some of the molten material freezes to form a thin skull on the surfaces of the receptacle, whereby additional molten material is not contaminated by said surfaces.

3. The method of claim 1 wherein the molten material is selected from the group consisting of metals, ceramic materials, metal alloys, and mixtures thereof.

4. The method of claim 2 wherein the molten material is a metal selected from the group consisting of iron, steel, titanium, niobium, tantalum, molybdenum, tungsten, copper, cobalt, zinc, lead, nickel, gold, silver, platinum, magnesium, silicon, aluminum, and alloys thereof.

5. The method of claim 2 wherein the molten material comprises titanium.

6. The method of claim 1 wherein there are two feeding sources, each laterally displaced from, adjacent to, perpendicular to, and contiguous with the intermediate section of the casting receptacle, whereby the directions of the flows of the molten material are from opposite sides of the intermediate section of the casting receptacle, whereby the flows from the feeding sources are opposing each other and are each transverse to the overflow from the exit lip onto the moving substrate.

7. The method of claim 6 wherein the molten material is selected from the group consisting of metals, ceramic materials, and metal alloys.

8. The method of claim 6 wherein the molten material is a metal selected from the group consisting of iron, steel, titanium, niobium, tantalum, molybdenum, tungsten, copper, cobalt, zinc, lead, nickel, gold, silver, platinum, magnesium, silicon, aluminum and alloys thereof.

9. A tundish for the rapid solidification of ribbon, filaments, fiber or film by melt overflow wherein the free upper surface of a molten material is raised above an exit lip formed in a wall of the tundish and overflowed over the exit lip against an upwardly moving substrate, the tundish comprising:

(a) a casting receptacle having said exit lip formed at one of its side walls; and (b) a first feeding source laterally adjacent and contiguous to the casting receptacle an extending from the casting receptacle substantially parallel to said exit lip to contain molten material having a free upper surface which is a horizontal extension of the free upper surface of the molten material in the casting receptacle, the first feeding source opening into the casting receptacle immediately upstream of the exit lip for allowing molten material to flow from the first feeding source into the casting receptacle along a path which makes a substantial turn in the horizontal plane to causing mixing of the molten material to improve its homogeneity.

10. A tundish in accordance with claim 9 wherein said casting receptacle comprises a refractory ceramic material.

11. A tundish in accordance with claim 9 wherein said casting receptacle comprises graphite.

12. A tundish in accordance with claim 9 wherein the tundish further comprises a second feeding source laterally adjacent and contiguous to the casting receptacle and extending from the casting receptacle oppositely from the first feeding source substantially parallel to said exit lip, the second feeding source opening into the casting receptacle immediately upstream of the exit lip for causing molten material to flow from the second feeding source into the casting receptacle along a path which makes a substantial turn in the horizontal plane to cause mixing of the molten material to improve its homogeneity.

13. A multilevel tundish apparatus for the rapid solidification of multilayer ribbon, filament, fiber or film by melt overflow wherein the free upper surface of a molten material is raised above an exit lip formed in a wall of a tundish and overflowed over the exit lip against an upwardly moving substrate, the tundish apparatus comprising:

(a) a first casting receptacle having a first exit lip formed at one of its side walls;

(b) a first feeding source laterally adjacent and contiguous to the first casting receptacle and extending from the first casting receptacle substantially parallel to said first exit lip to contain molten material having a free upper surface which is a horizontal extension of the free upper surface of the molten material in the first casting receptacle, the first feeding source opening into the first casting receptacle immediately upstream of the first exit lip for allowing molten material to flow from the first feeding source into the first casting receptacle along a path which makes a substantial turn in the horizontal plane to cause mixing of the molten material to improve its homogeneity;

(c) a second casting receptacle having a second exit lip formed in one of its walls and positioned above the first casting receptacle; and (d) a second feeding source laterally adjacent and contiguous to the second casting receptacle and extending from the second casting receptacle substantially parallel to said second exit lip to contain molten material having a free upper surface which is a horizontal extension of the free upper surface of the molten material in the second casting receptacle, the second feeding source opening into the second casting receptacle immediately upstream of the second exit lip for allowing molten material to flow from the second feeding source into the second casting receptacle along a path which makes a substantial turn in the horizontal plane to cause mixing of the molten material to improve its homogeneity.

* * * * *